US007186080B2

(12) United States Patent
Smiley, III et al.

(10) Patent No.: US 7,186,080 B2
(45) Date of Patent: Mar. 6, 2007

(54) FAN INLET AND HOUSING FOR A CENTRIFUGAL BLOWER WHOSE IMPELLER HAS FORWARD CURVED FAN BLADES

(75) Inventors: William A. Smiley, III, La Crosse, WI (US); Pravinchandra C. Mehta, Clarksville, TN (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/915,915

(22) Filed: Aug. 11, 2004

(65) Prior Publication Data

US 2006/0034686 A1 Feb. 16, 2006

(51) Int. Cl.
*F04D 29/44* (2006.01)

(52) U.S. Cl. ..... 415/205; 415/206

(58) Field of Classification Search ..... 415/203–206
See application file for complete search history.

(56) References Cited

U.S. PATENT DOCUMENTS

| | | | | |
|---|---|---|---|---|
| 1,862,523 A | | 6/1932 | Anderson | |
| 2,001,522 A | * | 5/1935 | Chester | 415/148 |
| 2,727,680 A | | 12/1955 | Madison et al. | |
| 2,798,658 A | | 7/1957 | McDonald | |
| 2,951,630 A | | 9/1960 | Murphy | |
| 2,981,461 A | | 4/1961 | Murphy | |
| 3,059,833 A | * | 10/1962 | Benoit | 415/208.2 |
| 3,070,287 A | * | 12/1962 | Eck | 416/183 |
| 3,217,976 A | | 11/1965 | Downs | |
| 3,221,983 A | | 12/1965 | Trickler et al. | |
| 3,306,528 A | * | 2/1967 | Eck | 415/116 |
| 3,307,776 A | | 3/1967 | White | |
| 3,627,440 A | | 12/1971 | Wood | |
| 4,890,547 A | * | 1/1990 | Wagner et al. | 454/356 |
| 5,279,515 A | | 1/1994 | Moore et al. | |
| 5,558,499 A | | 9/1996 | Kobayashi | |
| 5,570,996 A | | 11/1996 | Smiley, III | |
| 5,772,399 A | | 6/1998 | Mehta et al. | |

* cited by examiner

*Primary Examiner*—Edward K. Look
*Assistant Examiner*—Nathan Wiehe
(74) *Attorney, Agent, or Firm*—William J. Beres; William O'Driscoll

(57) ABSTRACT

A centrifugal blower with forward curved fan blades includes an inlet shroud whose shape is specifically designed for creating a smooth incoming airflow pattern that leads into the inner leading edges of the fan blades. The inlet shroud has first and second curved surfaces, wherein the centers of curvature of the two surfaces lie in the same plane, and the center of curvature as well as the radius of curvature of one curved surface is greater than that of the other. At least one center of curvature lies beyond the outer diameter of the impeller, and at least one center of curvature lies beyond the impeller's inner diameter, wherein the impeller's inner diameter is defined by the inner leading edges of the fan blades. Performance benefits are achieved when a forward curved blower with such an inlet shroud operates with a flow coefficient of between 9 and 52.

21 Claims, 3 Drawing Sheets

FAN INLET AND HOUSING FOR A CENTRIFUGAL BLOWER WHOSE IMPELLER HAS FORWARD CURVED FAN BLADES

BACKGROUND OF THE INVENTION

1. Field of the Invention

The subject invention generally pertains to centrifugal blowers whose impellers have forward curved fan blades and more specifically to a fan inlet shroud for such a blower.

2. Description of Related Art

Centrifugal blowers, such as those disclosed in U.S. Pat. Nos. 5,570,996; 5,558,499; 3,627,440; 3,307,776; 3,217,976; 2,981,461; 2,951,630; 2,798,658; 2,727,680; 3,221,983 and 1,862,523, are fans that draw air in an axial direction and discharge the air radially relative to the rotational axis of the blower's impeller. To create such a flow pattern, centrifugal blowers often include a scroll shaped housing or volute that contains an impeller of a particular design.

There are countless centrifugal impeller designs such as impellers with backward inclined fan blades, forward curve fan blades, radial or flat paddlewheel blades, airfoil or streamlined blades, and various combinations thereof. The present invention pertains to forward curved blades whose distinct operating characteristics make them suitable for applications that are quite different than that of backward inclined blades.

Backward inclined blades are generally for high pressure, low volume applications. Backward inclined blades, or at least their trailing edges, lean away from their direction of travel. Since volume generally increases with the axial width of the impeller and pressure generally increases with impeller diameter, impellers with backward inclined blades tend to have a relatively large outer diameter as compared to their narrow fan blade length (i.e., relatively large ratio of impeller diameter to axial blade length). Backward inclined blades are more sparsely distributed circumferentially around the impeller (lower solidity). The blades typically have a longer chord length, which is the distance between the blade's leading edge (at the impeller's inner diameter) and the blade's trailing edge (at the impeller's outer diameter). Impellers with backward inclined blades are generally quieter, faster, and more efficient than their forward curved counterparts.

To achieve such performance, minimizing the angle of attack of the incoming air is critically important with backward inclined blades, so the blower housing preferably includes an inlet shroud having a curved contour that accurately directs the incoming air in a favorable direction into the leading edge of the blade.

With forward curved blades, the airflow pattern across the blade is dramatically different. The blade edge near the impeller's outer diameter leans into rather than away from the blade's direction of travel. Thus the aerodynamic requirements of an inlet shroud can vary greatly between forward and backward inclined blades. Simply replacing the inlet shroud of any forward curved blade with that of a backward inclined blade will not necessarily provide desirable results.

In many respects, the desired results of a blower with forward curved blades are in stark contrast with that of blowers with backward inclined blades. Forward curved blades are generally for low pressure, high volume applications, such as moving air in a HVAC application. Impellers with forward curved blades have generally higher solidity, run at lower speeds, and usually operate at lower efficiency than impellers with backward inclined blades. Lower efficiency not only increases operating costs, but can also create high energy, low frequency noise, which is particularly difficult to suppress.

Since impellers with forward curved blades are often used in HVAC air moving applications where people are present, minimizing low frequency noise is important. Thus, there is an ongoing need for an ever quieter forward curved fan.

SUMMARY OF THE INVENTION

A primary object of the invention is to reduce the low frequency noise and improve the efficiency of a forward curved fan (a centrifugal blower with forward curved fan blades).

Another object of some embodiments of the invention is to provide a forward curved fan with an inlet shroud that has a recurved surface for increasing the effective length of the fan blades. The term, "recurved" refers to a surface whose contour first directs the airflow radially toward an impeller's rotational axis and then redirects the airflow away from the axis.

Another object of some embodiments is to provide a forward curved fan with an inlet shroud that has a recurved surface for minimizing flow vortices near the open axial end of the impeller.

Another object of some embodiments is to operate a forward curved fan within a certain range of flow coefficients to realize the benefit an inlet shroud with a recurved surface.

Another object of some embodiments is to provide a forward curved fan with an impeller having a certain range of blade solidity to realize the benefit of an inlet shroud with a recurved surface.

Another object of some embodiments is to provide a forward curved fan with an impeller whose axial blade length is at least three times as great as the blade's chord length to achieve the benefit of an inlet shroud with a recurved surface.

Another object of some embodiments is to size and position multiple curved surfaces of an inlet shroud in such a way as to improve the operating characteristics of a forward curved fan.

Another object of some embodiments is to provide a forward curved fan with a blade length that is between 0.7 and 1.6 times the impeller's outer radius to realize the benefit of an inlet shroud with a recurved surface.

The present invention provides a blower for moving air at a volume flow rate. The blower includes an impeller and a volute housing that includes a curved inlet shroud, wherein the volute housing defines a discharge opening, and the curved inlet shroud defines an air inlet. The air inlet has a inlet airflow cross-sectional area that lies substantially perpendicular to an outlet airflow cross-sectional area of the discharge opening. The impeller is mounted for rotation about a rotational axis within the volute housing, and the impeller includes a plurality of fan blades such that upon the impeller rotating at a rotational speed in a forward rotational direction. The plurality of fan blades force the air in a downstream direction from the air inlet to the discharge opening, and each fan blade of the plurality of curved fan blades has an inner edge, an outer edge, and a blade length that is substantially parallel to the rotational axis. The blower also includes an impeller outer radius extending between the rotational axis and the outer edge of at least one of the plurality of fan blades; an impeller inner radius extending between the rotational axis and the inner edge of at least one of the plurality of fan blades; and a first curved surface disposed on the curved inlet shroud. The first curved surface curves at a first radius about a first substantially circular centerline, wherein the first substantially circular centerline has a first centerline radius. The blower also includes a second curved surface disposed on the curved inlet shroud and downstream of the first curved surface. The second curved surface curves at a second radius about a second substantially circular centerline. The second substantially circular centerline has a second centerline radius. The first centerline radius is greater than the impeller inner radius. The first centerline radius is greater than the second centerline radius. The second radius is less than the impeller outer radius. The second radius is less than the first radius. The second centerline radius minus the second radius is less than the impeller inner radius.

The present invention further provides a blower for moving air at a volume flow rate. The blower includes a volute housing that includes a curved inlet shroud, wherein the volute housing defines a discharge opening, and the curved inlet shroud defines an air inlet. The air inlet has a inlet airflow cross-sectional area that lies substantially perpendicular to an outlet airflow cross-sectional area of the discharge opening. The blower also includes an impeller mounted for rotation about a rotational axis within the volute housing, wherein the impeller includes a plurality of curved fan blades such that upon the impeller rotating at a rotational speed in a forward rotational direction. The plurality of curved fan blades force the air in a downstream direction from the air inlet to the discharge opening, wherein each curved fan blade of the plurality of curved fan blades has an inner edge, a forward leaning outer edge that leans in the forward rotational direction, and a blade length that is substantially parallel to the rotational axis. The blower further includes an impeller outer radius extending between the rotational axis and the forward leaning outer edge of at least one of the plurality of curved fan blades, wherein the impeller outer radius is less than twice the blade length, and the blade length is less than twice the impeller outer radius so that the blower can provide a flow coefficient of between 9 and 52. The flow coefficient is defined as the volume flow rate divided by a product of the impeller outer radius cubed times the rotational speed of the impeller, wherein the volume flow rate is in units of cubic feet per minute, the impeller outer radius is in units of feet, and the rotational speed is in units of revolutions per minute. The blower also includes an impeller inner radius extending between the rotational axis and the inner edge of at least one of the plurality of curved fan blades; and a first curved surface disposed on the curved inlet shroud. The first curved surface curves at a first radius about a first substantially circular centerline. The first substantially circular centerline has a first centerline radius. The blower still further includes a second curved surface disposed on the curved inlet shroud and being downstream of the first curved surface. The second curved surface curves at a second radius about a second substantially circular centerline. The second substantially circular centerline has a second centerline radius. The first centerline radius is greater than the impeller inner radius. The first centerline radius is greater than the second centerline radius. The second radius is less than the impeller outer radius. The second radius is less than the first radius. The second centerline radius minus the second radius is less than the impeller inner radius.

The present invention also provides a blower for moving air at a volume flow rate. The blower includes a volute housing that includes a curved inlet shroud, wherein the volute housing defines a discharge opening, and the curved inlet shroud defines an air inlet. The air inlet has a inlet airflow cross-sectional area that lies substantially perpendicular to an outlet airflow cross-sectional area of the discharge opening. The blower also includes an impeller mounted for rotation about a rotational axis within the volute housing, wherein the impeller includes a plurality of curved fan blades such that upon the impeller rotating at a rotational speed in a forward rotational direction. The plurality of curved fan blades force the air in a downstream direction from the air inlet to the discharge opening, wherein each curved fan blade of the plurality of curved fan blades has an inner edge, a forward leaning outer edge that leans in the forward rotational direction, a chord length, and a blade length. The blade length is substantially parallel to the rotational axis, the chord length extends from the forward leaning outer edge to the inner edge, the blade length is at least three times greater than the blade chord length, and the impeller has a solidity of at least 0.5. The solidity is defined as the blade chord length divided by a blade pitch spacing. The blade pitch spacing equals a circumferential distance between adjacent curved fan blades of the plurality of curved fan blades. The blower further includes an impeller outer radius extending between the rotational axis and the forward leaning outer edge of at least one of the plurality of curved fan blades, wherein the impeller outer radius is less than twice the blade length, and the blade length is less than twice the impeller outer radius. The blower also includes an impeller inner radius extending between the rotational axis and the inner edge of at least one of the plurality of curved fan blades; and a first curved surface disposed on the curved inlet shroud. The first curved surface curves at a first radius about a first substantially circular centerline. The first substantially circular centerline has a first centerline radius that is greater than the impeller outer radius. The blower includes a second curved surface disposed on the curved inlet shroud and downstream of the first curved surface. The second curved surface curves at a second radius about a second substantially circular centerline. The second substantially circular centerline has a second centerline radius. The first centerline radius is greater than the second centerline radius. The second radius is less than the impeller outer radius. The second radius is less than the first radius. The second centerline radius minus the second radius is less than the impeller inner radius.

The present invention additionally provides a blower for moving air at a volume flow rate. The blower includes a volute housing that includes a curved inlet shroud, an impeller, an impeller outer radius, an impeller inner radius, a first curved surface, and a second curved surface. The volute housing defines a discharge opening. The curved inlet shroud defines an air inlet. The air inlet has a inlet airflow cross-sectional area that lies substantially perpendicular to an outlet airflow cross-sectional area of the discharge opening. The impeller is mounted for rotation about a rotational axis within the volute housing. The impeller includes a plurality of curved fan blades such that upon the impeller rotating at a rotational speed in a forward rotational direction. The plurality of curved fan blades force the air in a downstream direction from the air inlet to the discharge opening. Each curved fan blade of the plurality of curved fan blades has an inner edge, a forward leaning outer edge that leans in the forward rotational direction, and a blade length that is substantially parallel to the rotational axis. The impeller outer radius extends between the rotational axis and the forward leaning outer edge of at least one of the plurality of curved fan blades. The impeller inner radius extends between the rotational axis and the inner edge of at least one of the plurality of curved fan blades. The first curved surface is disposed on the curved inlet shroud. The first curved surface curves at a first radius about a first substantially circular centerline. The first substantially circular centerline has a first centerline radius. T second curved surface is disposed on the curved inlet shroud and being downstream of the first curved surface. The second curved surface curves at a second radius about a second substantially circular centerline. The second substantially circular centerline has a second centerline radius. The first centerline radius is greater than the impeller inner radius. The first centerline radius is greater than the second centerline radius. The second radius is less than the impeller outer radius. The second radius is less than the first radius. The second centerline radius minus the second radius is less than the impeller inner radius.

The present invention still further provides a housing for an impeller having an axis. The housing includes a first end wall lying in a first plane; a second end wall lying in a second plane substantially parallel to the first plane; a scroll wall joining the first and second end walls and a first curved inlet shroud in the first end wall. The scroll wall includes at least a portion having a continuously various radius relative to the axis of the impeller. The first curved inlet shroud has a first curved surface curving at a first radius about a first substantially circular centerline. The first substantially circular centerline has a first centerline radius. The first curved inlet shroud has a second curved surface disposed on the curved inlet shroud downstream of the first curved surface. The second curved surface curves at a second radius about a second substantially circular centerline and the second substantially circular centerline has a second centerline radius. The first centerline radius is greater than the second centerline radius and the second radius is less than the first radius.

One or more of these and/or other objects of the invention are provided by a centrifugal blower that includes a housing containing an impeller with forward curved fan blades, wherein the housing includes an inlet shroud with a recurved surface that efficiently directs the incoming airflow into the impeller.

DESCRIPTION OF THE PREFERRED EMBODIMENTS

Figure 1:
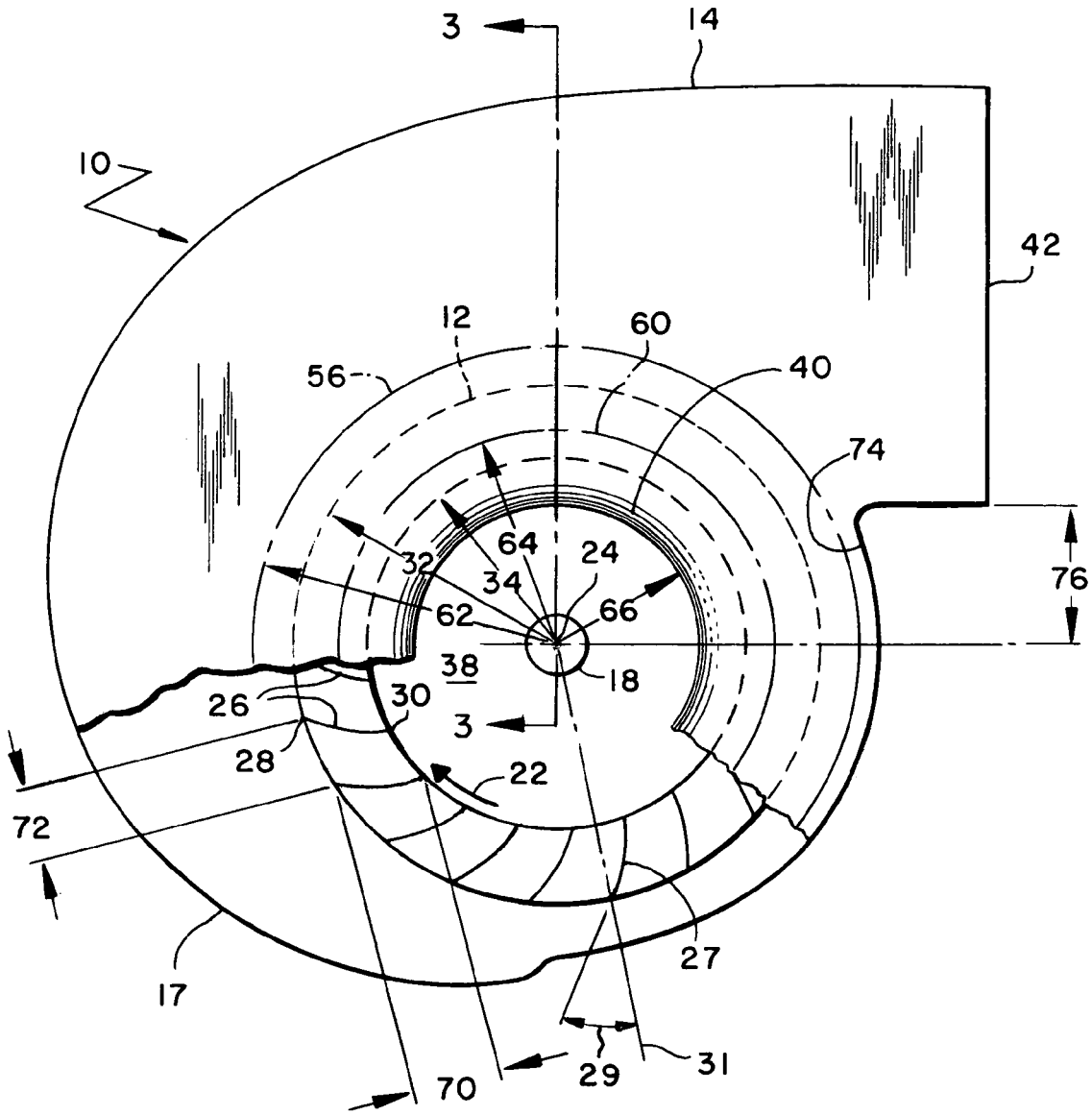
FIG. 1 is a side view of a centrifugal blower with a portion of the blower's housing and the impeller's shroud plate cutaway to show forward curved blades of the blower's impeller, wherein the blower includes an inlet shroud according to the subject invention.
Figure 2:
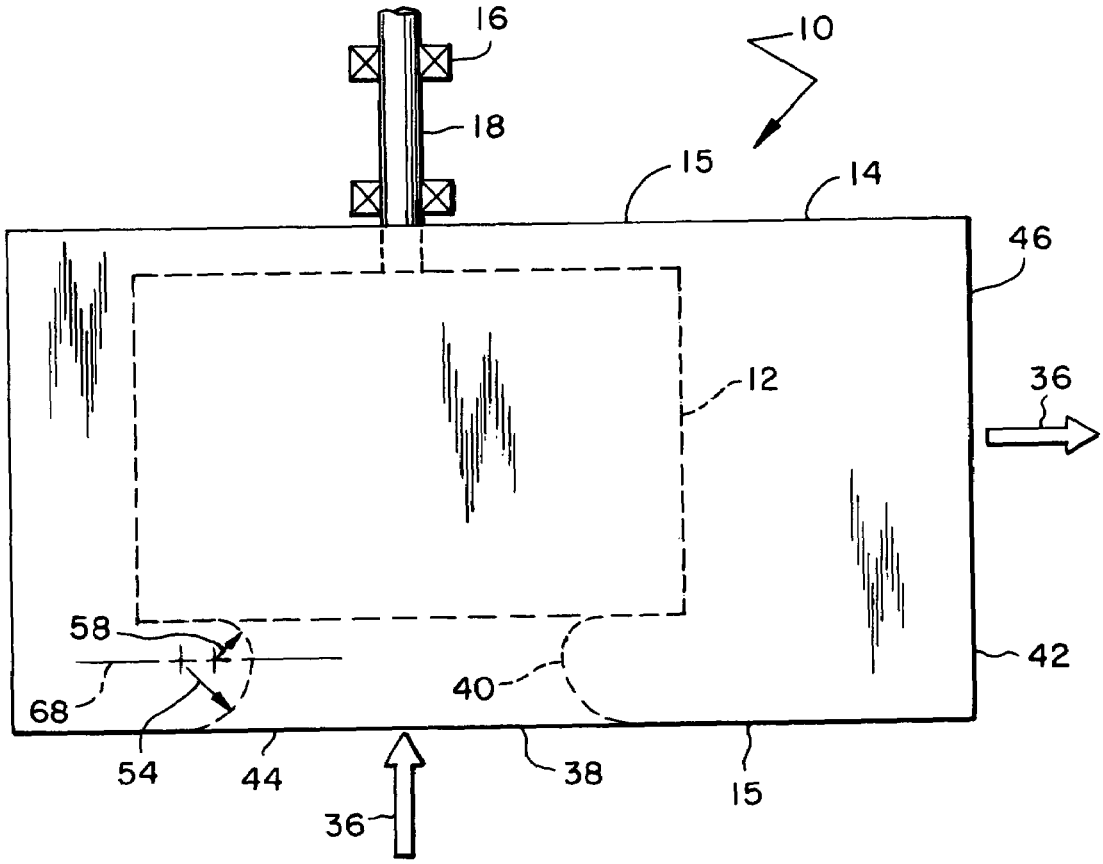
FIG. 2 is a top view of the blower of FIG. 1.
Figure 3:
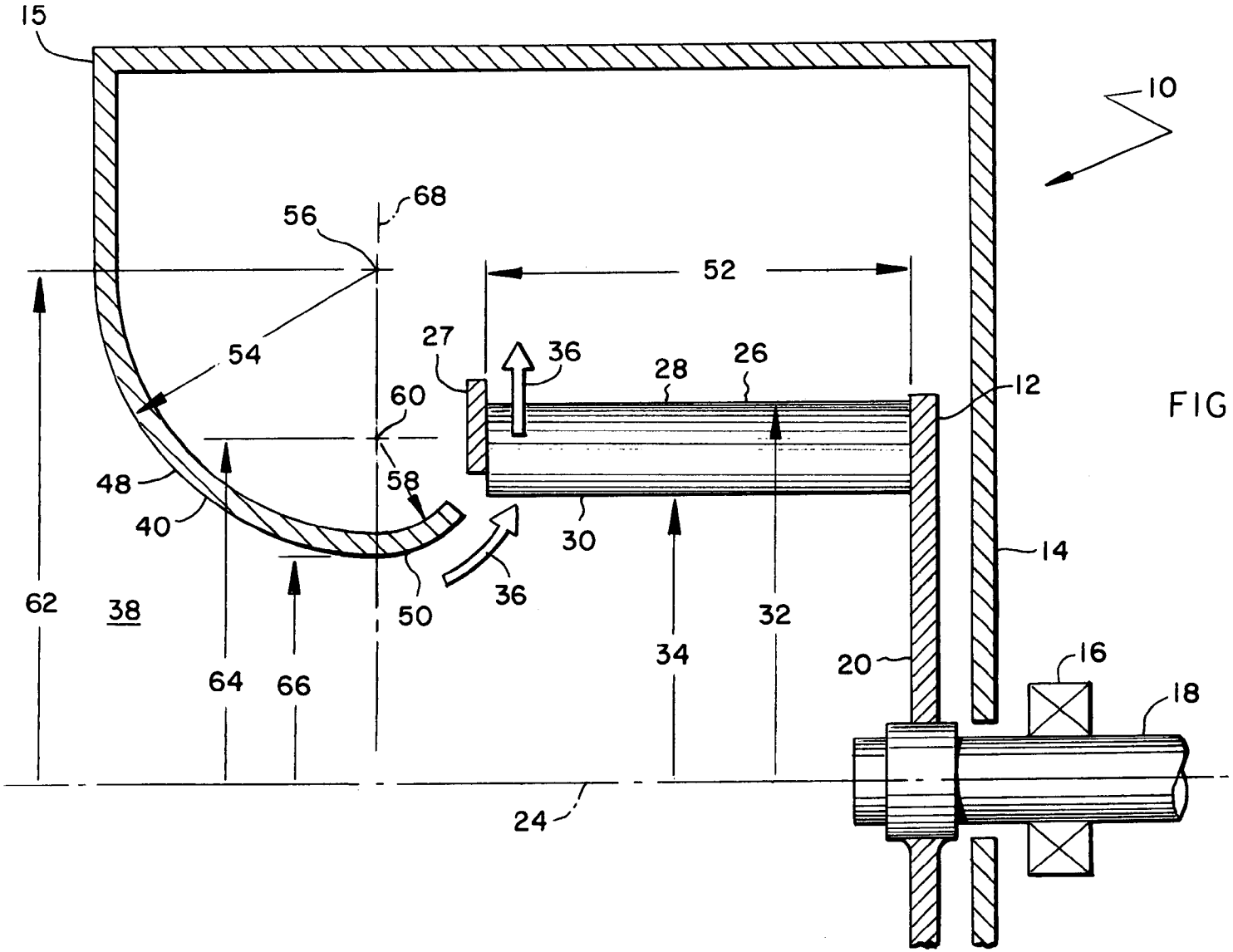
FIG. 3 is a cross-sectional view taken along line 3—3 of FIG. 1.

FIGS. 1–3 show a centrifugal fan or blower 10 that includes an impeller 12 mounted for rotation within a volute or scroll shaped housing 14 including first and second end walls 15 and a scroll wall 17 having at least a portion with a continuously increasing radius relative to a rotational axis 24. One or more bearings 16 support a shaft 18 that is connected to a circular hub plate 20 of impeller 12 such that a motor or some other drive mechanism can rotate impeller 12 in a forward rotational direction 22 about the rotational axis 24.

Impeller 12 comprises a plurality of forward curved fan blades 26 axially interposed between hub plate 20 and an annular shroud plate 27. The term, "forward curved" refers to a fan blade having a surface near its outer trailing edge that leans into the blade's direction of travel. Each blade 26, for example, has a surface adjacent a trailing outer edge 28 that lies at a positive angle 29 relative to a radial centerline 31 extending from axis 24. Angle 29 is preferably between 5 and 60 degrees. Trailing edge 28 of each of the fan blades lies along an outer radius 32 of impeller 12, wherein axis 24 is the center of radius 32. An inner leading edge 30 of each of the fan blades lies along an inner radius 34 whose center is also rotational axis 24.

As impeller 12 rotates, it draws air 36 from an air inlet 38 defined by a curved inlet shroud 40 on at least one end wall 15 of housing 14 and discharges the air through a discharge opening 42 of housing 14. An airflow cross-sectional area 44 of inlet 38 and an airflow cross-sectional area 46 of discharge opening 42 lie generally perpendicular to each other. The term, "airflow cross-sectional area" refers to an imaginary plane that lies perpendicular to the general direction of airflow in the area of interest.

To minimize airflow losses and their associated noise, inlet shroud 40 includes a first curved surface 48 and a second curved surface 50 that carefully direct the incoming airflow into the inner or leading edges of the fan blades. Each fan blade 26 has a length 52 that extends from hub plate 20 to shroud plate 27, and inlet shroud 40 is designed to take advantage of that entire length. In particular, inlet shroud 40 is designed for providing a continuous flow of air rather than creating vortices in the area of the blades that are closest to shroud plate 27. The curvatures and positions of surfaces 48 and 50 are strategically chosen with consideration of various other structural and operational aspects of blower 10.

More specifically, first surface 48 curves along a first radius 54 whose center is a first substantially circular centerline 56, and second surface 50 curves along a second radius 58 whose center is a second substantially circular centerline 60. A first centerline radius 62 defines first circular centerline 56, and a second centerline radius 64 defines second circular centerline 60.

To ensure smooth incoming airflow, centerlines 56 and 60 lie on preferably the same plane 68, first centerline radius 62 is greater than the impeller's inner radius 34, first centerline radius 62 is greater than second centerline radius 64, second radius 58 is less than the impeller's outer radius 32, second radius 58 is less than first radius 54, and second centerline radius 64 minus second radius 58 is less than the impeller's inner radius 34.

Although such a design does not necessarily provide good performance at all operating conditions, the design is particularly beneficial for blowers having a particular flow coefficient. For blowers having a single inlet, as is the case with blower 10, the flow coefficient is preferably between 9 and 27 with the flow coefficient being defined as the volume flow rate divided by a product of the impeller outer radius cubed times the rotational speed of the impeller, wherein the volume flow rate is in units of cubic feet per minute, the impeller outer radius is in units of feet, and the rotational speed is in units of revolutions per minute. For dual-inlet blowers (inlets at opposite axial ends of the impeller), the flow coefficient is preferably between 20 and 52.

Further improvement of performance may be achieved when first centerline radius 62 is greater than the impeller's outer radius 32, the impeller's outer radius 32 is less than twice blade length 52, and blade length 52 is less than twice the impeller's outer radius 32. Second centerline radius 64 is preferably between impeller inner radius 34 and impeller outer radius 32. First centerline radius 62 is preferably greater than impeller outer radius 32 and less than 1.4 times impeller outer radius 32. Blade length 52 is preferably between 0.7 and 1.6 times impeller outer radius 32. And impeller outer radius 32 divided by impeller inner radius 34 is preferably between 1.1 and 1.3.

A smooth transition between first curved surface 48 and second curved surface 50 can be created by having first centerline radius 62 minus first radius 54 being substantially equal to second centerline radius 64 minus second radius 58. Also, inlet shroud 40 can be provided with a minimum throat radius 66 that is not only substantially equal to second centerline radius 64 minus second radius 58 but is also substantially equal to first centerline radius 62 minus first radius 54. Throat radius 66 is preferably greater than 0.6 times impeller inner radius 34 but less than impeller radius 34.

The full benefit of inlet shroud 40 can be realized when impeller 12 has a solidity of at least 0.5, wherein solidity is defined as the blade chord length 70 (linear distance between leading edge 30 and trailing edge 28) divided by a blade pitch spacing, wherein the blade pitch spacing equals a circumferential distance 72 between adjacent fan blades. Also, blade length 52 is preferably at least three times as great as chord length 70.

In some cases, blower 10 may be provided with a fixed or movable cutoff 74 whose height 76 is set to optimize the blower's performance at a particular flow rate. Such a cutoff is disclosed in U.S. Pat. No. 5,772,399, which is specifically incorporated by reference herein. Also, housing 14 can be provided with a "conformal portion" a "scroll portion" and/or a "restrictor plate" as disclosed in U.S. Pat. No. 5,570,996, which is specifically incorporated by reference herein.

Although the invention is described with reference to a preferred embodiment, it should be appreciated by those of ordinary skill in the art that other variations are well within the scope of the invention. Therefore, the scope of the invention is to be determined by reference to the following

The invention claimed is:

1. A blower for moving air at a volume flow rate, comprising:

a volute housing that includes a curved inlet shroud, wherein the volute housing defines a discharge opening, and the curved inlet shroud defines an air inlet, wherein the air inlet has a inlet airflow cross-sectional area that lies substantially perpendicular to an outlet airflow cross-sectional area of the discharge opening;

an impeller mounted for rotation about a rotational axis within the volute housing, wherein the impeller includes a plurality of curved fan blades such that upon the impeller rotating at a rotational speed in a forward rotational direction, the plurality of curved fan blades force the air in a downstream direction from the air inlet to the discharge opening, wherein each curved fan blade of the plurality of curved fan blades has an inner edge, a forward leaning outer edge that leans in the forward rotational direction, and a blade length that is substantially parallel to the rotational axis;

an impeller outer radius extending between the rotational axis and the forward leaning outer edge of at least one of the plurality of curved fan blades, wherein the impeller outer radius is less than twice the blade length, and the blade length is less than twice the impeller outer radius so that the blower can provide a flow coefficient of between 9 and 52, wherein the flow coefficient is defined as the volume flow rate divided by a product of the impeller outer radius cubed times the rotational speed of the impeller, wherein the volume flow rate is in units of cubic feet per minute, the impeller outer radius is in units of feet, and the rotational speed is in units of revolutions per minute;

an impeller inner radius extending between the rotational axis and the inner edge of at least one of the plurality of curved fan blades;

a first curved surface disposed on the curved inlet shroud, wherein the first curved surface curves at a first radius about a first substantially circular centerline, wherein the first substantially circular centerline has a first centerline radius; and a second curved surface disposed on the curved inlet shroud and being downstream of the first curved surface, wherein the second curved surface curves at a second radius about a second substantially circular centerline, the second substantially circular centerline has a second centerline radius, the first centerline radius is greater than the impeller inner radius, the first centerline radius is greater than the second centerline radius, the second radius is less than the impeller outer radius, the second radius is less than the first radius, and the second centerline radius minus the second radius is less than the impeller inner radius.

2. The blower of claim 1, wherein the blade length is greater than 0.7 times the impeller outer radius and less than 1.6 times the impeller outer radius.

3. The blower of claim 1, wherein the second centerline radius is greater than the impeller inner radius and less than the impeller outer radius.

4. The blower of claim 1, wherein the first centerline radius is greater than the first radius and less than 1.4 times the first radius.

5. A blower for moving air at a volume flow rate, comprising:

a volute housing that includes a curved inlet shroud, wherein the volute housing defines a discharge opening, and the curved inlet shroud defines an air inlet, wherein the air inlet has a inlet airflow cross-sectional area that lies substantially perpendicular to an outlet airflow cross-sectional area of the discharge opening;

an impeller mounted for rotation about a rotational axis within the volute housing, wherein the impeller includes a plurality of curved fan blades such that upon the impeller rotating at a rotational speed in a forward rotational direction, the plurality of curved fan blades force the air in a downstream direction from the air inlet to the discharge opening, wherein each curved fan blade of the plurality of curved fan blades has an inner edge, a forward leaning outer edge that leans in the forward rotational direction, a chord length, and a blade length wherein the blade length is substantially parallel to the rotational axis, the chord length extends from the forward leaning outer edge to the inner edge, the blade length is at least three times greater than the blade chord length, the impeller has a solidity of at least 0.5, wherein the solidity is defined as the blade chord length divided by a blade pitch spacing, wherein the blade pitch spacing equals a circumferential distance between adjacent curved fan blades of the plurality of curved fan blades;

an impeller outer radius extending between the rotational axis and the forward leaning outer edge of at least one of the plurality of curved fan blades, wherein the impeller outer radius is less than twice the blade length, and the blade length is less than twice the impeller outer radius;

an impeller inner radius extending between the rotational axis and the inner edge of at least one of the plurality of curved fan blades;

a first curved surface disposed on the curved inlet shroud, wherein the first curved surface curves at a first radius about a first substantially circular centerline, wherein the first substantially circular centerline has a first centerline radius that is greater than the impeller outer radius; and a second curved surface disposed on the curved inlet shroud and being downstream of the first curved surface, wherein the second curved surface curves at a second radius about a second substantially circular centerline, the second substantially circular centerline has a second centerline radius, the first centerline radius is greater than the second centerline radius, the second radius is less than the impeller outer radius, the second radius is less than the first radius, and the second centerline radius minus the second radius is less than the impeller inner radius.

6. The blower of claim 5, wherein the impeller outer radius divided by the impeller inner radius is greater than 1.1 and less than 1.3.

7. The blower of claim 5, wherein the blower has a flow coefficient of between 9 and 52, wherein the flow coefficient is defined as the volume flow rate divided by a product of the impeller outer radius cubed times the rotational speed of the impeller, wherein the volume flow rate is in units of cubic feet per minute, the impeller outer radius is in units of feet, and the rotational speed is in units of revolutions per minute.

8. A blower for moving air at a volume flow rate, comprising:

a volute housing that includes a curved inlet shroud, wherein the volute housing defines a discharge opening, and the curved inlet shroud defines an air inlet, wherein the air inlet has a inlet airflow cross-sectional area that lies substantially perpendicular to an outlet airflow cross-sectional area of the discharge opening;

an impeller mounted for rotation about a rotational axis within the volute housing, wherein the impeller includes a plurality of curved fan blades such that upon the impeller rotating at a rotational speed in a forward rotational direction, the plurality of curved fan blades force the air in a downstream direction from the air inlet to the discharge opening, wherein each curved fan blade of the plurality of curved fan blades has an inner edge, a forward leaning outer edge that leans in the forward rotational direction, and a blade length that is substantially parallel to the rotational axis;

an impeller outer radius extending between the rotational axis and the forward leaning outer edge of at least one of the plurality of curved fan blades;

an impeller inner radius extending between the rotational axis and the inner edge of at least one of the plurality of curved fan blades;

a first curved surface disposed on the curved inlet shroud, wherein the first curved surface curves at a first radius about a first substantially circular centerline, wherein the first substantially circular centerline has a first centerline radius; and a second curved surface disposed on the curved inlet shroud and being downstream of the first curved surface, wherein the second curved surface curves at a second radius about a second substantially circular centerline, the second substantially circular centerline has a second centerline radius, the first centerline radius is greater than the impeller inner radius, the first centerline radius is greater than the second centerline radius, the second radius is less than the impeller outer radius, the second radius is less than the first radius, and the second centerline radius minus the second radius is less than the impeller inner radius.

9. The blower of claim 8, wherein the blower has a flow coefficient of between 9 and 27, wherein the flow coefficient is defined as the volume flow rate divided by a product of the impeller outer radius cubed times the rotational speed of the impeller, wherein the volume flow rate is in units of cubic feet per minute, the impeller outer radius is in units of feet, and the rotational speed is in units of revolutions per minute.

10. The blower of claim 8, wherein the blower has a flow coefficient of between 20 and 52.

11. The blower of claim 8, wherein the blade length is greater than 0.7 times the impeller outer radius and less than 1.6 times the impeller outer radius.

12. The blower of claim 8, wherein the first centerline radius minus the first radius is substantially equal to the second centerline radius minus the second radius.

13. The blower of claim 8, wherein the curved inlet shroud has a throat radius that is substantially equal to the second centerline radius minus the second radius.

14. The blower of claim 8, wherein the curved inlet shroud has a throat radius that is substantially equal to the first centerline radius minus the first radius.

15. The blower of claim 14, wherein the throat radius is greater than 0.6 times the impeller inner radius and less than the impeller inner radius.

16. The blower of claim 8, wherein the second centerline radius is greater than the impeller inner radius and less than the impeller outer radius.

17. The blower of claim 8, wherein the first centerline radius is greater than the first radius and less than 1.4 times the first radius.

18. The blower of claim 8, wherein a blade chord length extends from the inner edge to the forward leaning outer edge, and the blade length is at least three times greater than the blade chord length.

19. The blower of claim 18, wherein the impeller has a solidity of at least 0.5, wherein the solidity is defined as the blade chord length divided by a blade pitch spacing, wherein the blade pitch spacing equals an outer circumferential distance between adjacent curved fan blades of the plurality of curved fan blades.

20. The blower of claim 8, wherein the impeller outer radius divided by the impeller inner radius is greater than 1.1 and less than 1.3.

21. A housing for an impeller having an axis, the housing comprising:

a first end wall lying in a first plane;

a second end wall lying in a second plane substantially parallel to the first plane;

a scroll wall joining the first and second end walls wherein the scroll wall includes at least a portion having a continuously various radius relative to the axis of the impeller;

the impeller mounted for rotation about the axis within the housing and having a plurality of fan blades such that each fan blade of the plurality of curved fan blades has a forward leaning outer edge that leans in a forward rotational direction; and a first curved inlet shroud in the first end wall, the first curved inlet shroud having a first curved surface curving at a first radius about a first substantially circular centerline, wherein the first substantially circular centerline has a first centerline radius, and a second curved surface disposed on the first curved inlet shroud downstream of the first curved surface, wherein the second curved surface curves at a second radius about a second substantially circular centerline and the second substantially circular centerline has a second centerline radius; and wherein the first centerline radius is greater than the second centerline radius and the second radius is less than the first radius.

* * * * *

UNITED STATES PATENT AND TRADEMARK OFFICE

CERTIFICATE OF CORRECTION

PATENT NO. : 7,186,080 B2
APPLICATION NO. : 10/915915
DATED : March 6, 2007
INVENTOR(S) : William A. Smiley, III and Pravinchandra C. Mehta It is certified that error appears in the above-identified patent and that said Letters Patent is hereby corrected as shown below:

Column 2, lines 52-53 “a inlet” should read --an inlet--

Column 3, line 21 “a inlet” should read --an inlet--

Column 4, line 2 “a inlet” should read --an inlet--

Column 4, line 52 “a inlet” should read --an inlet--

Column 5, line 6 “T second” should read --The second--

In The Claims:

Claim 1, line 6 “a inlet” should read --an inlet--

Claim 5, line 6 “a inlet” should read --an inlet--

Claim 8, line 6 “a inlet” should read --an inlet--

Signed and Sealed this

Twenty-fourth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,186,080 B2
APPLICATION NO. : 10/915915
DATED : March 6, 2007
INVENTOR(S) : William A. Smiley, III and Pravinchandra C. Mehta It is certified that error appears in the above-identified patent and that said Letters Patent is hereby corrected as shown below:

Column 2, lines 52-53 “a inlet” should read --an inlet--

Column 3, line 21 “a inlet” should read --an inlet--

Column 4, line 2 “a inlet” should read --an inlet--

Column 4, line 52 “a inlet” should read --an inlet--

Column 5, line 6 “T second” should read --The second--

In The Claims:

Column 7, Claim 1, line 48 “a inlet” should read --an inlet--

Column 8, Claim 5, line 42 “a inlet” should read --an inlet--

Column 9, Claim 8, line 39 “a inlet” should read --an inlet--

This certificate supersedes the Certificate of Correction issued June 24, 2008.

Signed and Sealed this

Twenty-second Day of July, 2008

JON W. DUDAS
*Director of the United States Patent and Trademark Office*